United States Patent [19]

Theckston

BEST AVAILABLE COPY

[11] 4,000,018

[45] Dec. 28, 1976

[54] MANGANESE STEELS

[75] Inventor: Alexander Theckston, Mulgrave, Australia

[73] Assignee: Comair Pty. Ltd., Australia

[22] Filed: Nov. 13, 1974

[21] Appl. No.: 523,531

[30] Foreign Application Priority Data

May 30, 1974 Australia ..... 9147/74
May 29, 1973 Australia ..... 56237/73

[52] U.S. Cl. ..... 148/38; 75/126 B; 75/126 H; 148/37; 148/137

[51] Int. Cl.[2] ..... C22C 38/38

[58] Field of Search ..... 148/137, 38, 37; 75/126 B, 126 H

[56] References Cited

UNITED STATES PATENTS

| | | | |
|---|---|---|---|
| 2,115,465 | 4/1938 | Merten | 75/126 B |
| 2,965,478 | 12/1960 | Armitage | 148/137 |
| 3,113,861 | 12/1963 | Norman | 148/137 |

FOREIGN PATENTS OR APPLICATIONS

| | | | |
|---|---|---|---|
| 157,224 | 4/1922 | United Kingdom | 148/37 |

*Primary Examiner*—Arthur J. Steiner
*Attorney, Agent, or Firm*—Cushman, Darby & Cushman

[57] ABSTRACT

A method of manufacturing a manganese steel which comprises the steps of subjecting an alloy having the following composition by weight: carbon 0.9 to 1.4%; manganese 3.0 to 8.0%; chromium 1.0 to 2.5%; molybdenum 0.5 to 2.5%; silicon 0.25 to 2.0%; cobalt 1.0 to 5.0%; with the balance iron plus incidental impurities, to heating at a temperature within the range 900° to 1100° C. and then cooling the alloy to a temperature below 200° C. to produce a wear-resistant manganese steel having a predominantly austenite content. The predominantly austenite steel may be converted to predominantly pearlite steel by a subsequent heating step at 500° to 690° C. for at least one hour. That predominantly pearlite steel may be hardened to a Rockwell C-scale hardness in excess of 50 by further heating step between 690° to 800° C. for at least 5 minutes.

7 Claims, 6 Drawing Figures

MANGANESE STEELS

Figure 1:
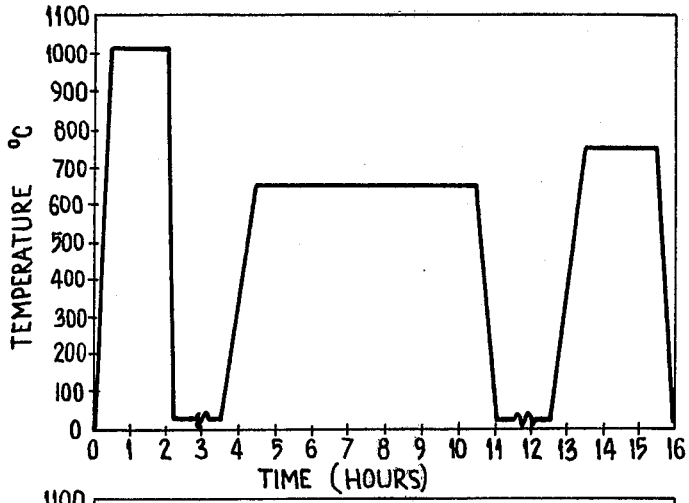

This invention relates to improved manganese steels, their composition and heat treatment, and to a method of manufacturing a manganese steel and to the product so produced.

The need for wear and impact resistant steels is known. They are used, for example, in the mining and quarrying industries for hammers, breaker bars, jaw crushers, crushing rolls, balls, screens and liners and in the civil engineering industry for bucket teeth for various types of loaders and dredges, drills, chisels and blades for graders.

Hitherto there has existed a range of austenitic manganese steels containing 12 to 14% of manganese and about 1% of carbon by weight, with or without other alloying additions. These austenites are relatively soft and the steels derive their usefulness from their capacity to "work harden" under strain. Work hardening results from the transformation of the state of the steel from the relatively soft austenite to a relatively harder state during working. The capacity to work harden thus depends on the instability of the austenite.

However these austenitic 12 to 14% manganese steels have three main disadvantages:

a. Their capacity to work harden means that they can be machined by conventional methods only with great difficulty. This makes them unsuitable for a variety of applications in which wear resistance is desirable but the parts can be brought to the desired shape only by suitable machining.

b. Work hardening generally occurs only under fairly severe working. The steel hardens rather poorly under relatively gentle abrasion and it is thus insufficiently abrasion resistant for some applications.

c. Even by severe work hardening the maximum hardness achieved is usually only about 54 Rockwell 'C'. While this may be adequate for many applications, it is desirable to have a steel which can be made significantly harder.

Some attempts have been made to overcome the first of these difficulties by prolonged tempering heat treatment. This treatment converts some of the austenite to pearlite which is less prone to work hardening. In this semipearlitic condition, the steel can be machined to some extent. However, the conversion to pearlite is generally incomplete and only a limited amount of machining is possible. Moreover the heat treatment is prolonged and costly and this in itself makes it impractical to many applications.

The second and third difficulties represent inherent limitations of the conventional 12 to 14% manganese steels. However a range of iron alloys has been developed for applications in which extreme hardness is the primary requisite. By varying the carbon, nickel, molbydenum and chromium content of these alloys, hardnesses in the range 54–62 Rockwell 'C' can be achieved. These alloyed cast irons are widely used, but, like the austenite 12 to 14% manganese steels, they cannot readily be machined by conventional methods and so are unsuitable for a variety of applications in which their hardness would otherwise make them valuable. Moreover, many are brittle and therefore stand up to impact badly. They therefore introduce the problem of regular breakage and hence high maintenance cost of capital equipment.

Thus existing wear-resistant alloys leave much to be desired. The need for a wear-resistant but machinable alloy is of significant importance. However, it should also be mentioned that regardless of machinability even a small increase in wear and/or impact resistance can produce substantial savings in the cost of replacing worn or broken parts.

Accordingly the primary object of the present invention is to provide a improved method of manufacturing manganese steels, and improved manganese steels produced by such method, whereby the abovementioned problems are reduced or minimised.

Accordingly the present invention provides a manganese steel having a composition by weight of: carbon 0.9 to 1.4%, manganese 3.0 to 8.0%, chromium 1.0 to 2.5%, molybdenum 0.5 to 2.5%, silicon 0.25 to 2%, with the balance iron plus incidental impurities.

Preferably the manganese steel has a composition in which the percentage ranges are as follows: carbon 1.1 to 1.3%, manganese 5.0 to 6.3%, chromium 1.6 to 2.2%, molybdenum 1.4 to 2.0% and silicon 0.8 to 1.4%, with the balance iron plus incidental impurities.

The manganese steels provided by the invention may exist in more than one metallurgical state. In one state they may have a predominantly pearlite structure and so can be machined considerably more readily than the conventional austenitic 12 to 14% manganese steels which as mentioned have work hardening problems. In other states the manganese steels according to the invention may exhibit improved wear and/or impact resistance qualities and it has been discovered that conversion between these various states can be achieved as will hereinafter be described.

In a preferred composition the manganese steel according to the invention has a composition by weight of carbon about 1.2%, manganese about 6%, chromium about 2%, molybdenum about 2%, silicon about 1.0% with the balance iron plus incidental impurities.

It has been found that cobalt affects the hardness and the machinability of the steel. Accordingly, the proportion of cobalt included varies according to the intended application of the steel and depends on the relative importance of the hardness and machinability desired. The cobalt content may be varied from 1 to 5%. Above 5% the high cost may be uneconomical.

Vanadium may be included in the manganese steel composition up to 2% by weight.

Other elements may be present in the manganese steels according to the invention in various ways. For example, extraneous components may be carried into the alloy composition via original feedstock materials. Alternatively they may be in the nature of residual deoxidants or other residuals arising from use of treating agents in an intermediate or other stage of production. Examples of elements that may be present in small amounts include nickel, sulphur, tungsten and phosphorus. In practice these individual elements are generally present in total amounts less than 2% by weight.

The steels described in the present invention can exist in a state with a pearlite content in excess of 50%, preferably in excess of 65%. In this state they are more readily machinable than conventional austenitic manganese steels. It has been found that a method for converting them to the predominently pearlite state consists of subjecting them to a temperature within the range 500 to 690° C for periods in excess of 1 hour.

Furthermore, the steels described in the present invention can be converted to a state having a predominantly austenite content. In such a state the said steels show increased wear resistance, compared to conventional 12 to 14% manganese steels. This wear resistance arises for at least two reasons. First, the said austenitic manganese steels have the capacity to work harden. It has been found that some of the steels described in the present invention work harden more readily than do some conventional 12 to 14% manganese steels. Furthermore, it has been found that the surface layer produced during work hardening can itself be significantly harder than the surface layers produced by work hardening some conventional 12 to 14% manganese steels. Secondly, it has been found that wear resistance is improved by a higher volume of particles of hard metallic carbide which are dispersed regularly throughout the relatively soft and ductile austenitite. This high proportion of metallic carbides gives superior wear resistance when compared with other lean manganese steels which are sometimes used. The size, shape and distribution of the carbide particles can be varied by altering the proportions of the alloying additions in the alloy and also by altering the thermal treatment. It has been found possible to obtain steels with carbide particles dispersed throughout the austenite and not only at grain boundaries. These steels have improved wear resistance without undue brittleness.

The invention includes a method of manufacturing a wear resistant manganese steel having a predominantly austenitic content which comprises the steps of heating an alloy of the composition hereinbefore stated at a temperature within the range 900° to 1100° C, preferably within the range 980° to 1020° C, and then cooling the alloy to a temperature below 200° C. Cooling may be effected rapidly, for example by a water or oil quench or a forced air draft and is preferably effected at a sufficiently rapid rate to avoid the formation of pearlite in depths up to 3 inches from the surface of the cooled alloy. The said cooling is preferably effected over a period of less than 1 hour.

The invention also includes a method of manufacturing a manganese steel having a predominantly pearlitic content which comprises subjecting the austenitic alloy above described to heating within the temperature range 500° to 690° C for a period in excess of 1 hour. The alloy may then be cooled to a temperature below 200° C and is found to be capable of maching by normal methods.

The invention also includes the manufacture of manganese steels of the kind described which possess a hardness in excess of 50 on the Rockwell 'C' scale, preferably a hardness in excess of 58 on the said scale. Hardnesses in the range of 62 to 65 on the said scale have been achieved.

According to the invention a method of producing a manganese steel in the said hardened state comprises subjecting the steel in a predominantly pearlitic state to a temperature within the range of 690° to 800° C for a period in excess of 5 minutes, preferably for a period between 30 minutes and 25 hours. With some of the manganese steels tested, maximum hardness has been achieved by subjecting the steel to a temperature within the range 690° to 760° C. The steel may then be cooled to below 50° C and is found to have a martensitic microstructure.

To obtain optimum hardening the time at temperature in the range 690° to 800° C depends on:

a. the actual temperature selected b. the composition of the alloy selected but because of the stability of the alloy carbides, fast heating rates and short times at temperature, as taught by some prior methods, are not necessary requirements of the method of this invention.

Additionally, because the hardenability of the manganese steel of this invention is sufficiently high, the final martensitic microstructure of the hardened steel can be obtained without severe quenching, e.g., with air cooling, thus reducing the likelihood of cracking during hardening.

A feature of the manganese steels of the present invention is that they can exist in more than one metallurgical state and can be converted from one state to another. For instance, they can be converted to a predominantly austenitic state by subjection to a temperature within the range 900° to 1100° C followed by cooling as above described. Having been cooled (at least to below 690° C) they can then be converted to a predominantly pearlitic state by subjection to a temperature within the range 500° to 690° C for a period in excess of 1 hour. In this predominantly pearlitic state they are more readily machinable. If it is necessary to use the steel in a context in which wear resistance with good ductility is important, the steel can be reconverted from a predominantly pearlitic to a predominantly austenitic state by further subjection to a temperature within the range 900° to 1100° C followed by cooling as above described. Alternatively, if the steel is required to have maximum hardness it can be converted from a predominantly pearlitic state to a hardened state by subjection to a temperature within the range 690° to 800° C, followed by cooling to below 50° C.

The fact that these steels can be converted to a machinable predominantly pearlitic state not only makes shaping easier for many existing applications but also permits working parts to be formed in a variety of shapes which would be difficult to obtain with some conventional 12 to 14% manganese steels. The fact that these steels in their predominantly austenitic state work harden more readily than some conventional manganese steels leads to improved performance with many existing applications in which wear resistance is important. It also makes easier some further applications in which the steel suffers relatively gentle abrasion in use. This abrasion has hitherto sometimes been insufficient to produce adequate work hardening. In the hardened state some of the steels have had higher hardnesses than chilled and/or alloyed cast irons but have been found to be less brittle. They are useful for applications in which hardness is of importance but problems have hitherto been encountered through breakage of working parts. They are also important for applications in which it is desired to machine the steels before hardening.

Figure 2:
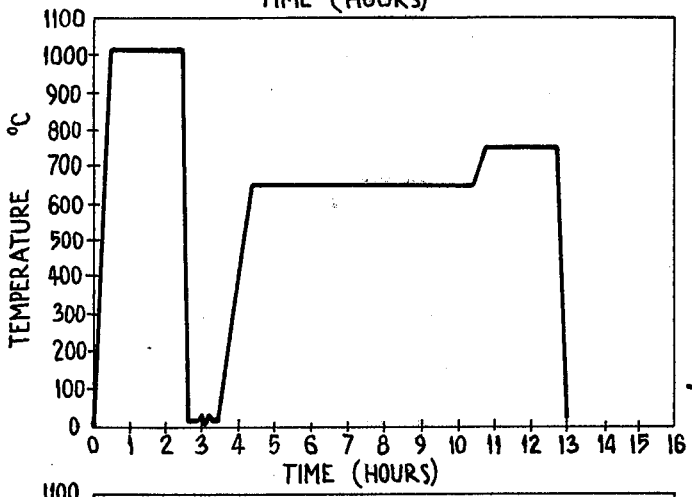
Figure 3:
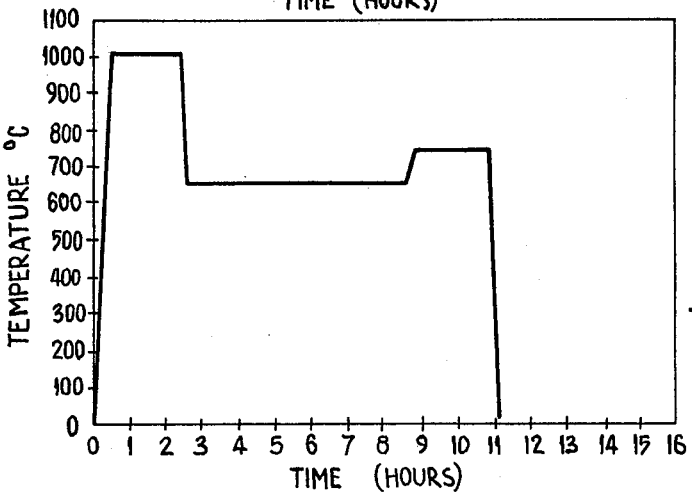

In the accompanying drawings, FIGS. 1, 2 and 3 are time-temperature graphs which illustrate respectively three methods of producing a hardened manganese steel according to this invention. The temperatures shown are within the ranges specified herein and are not critical. The times indicated are nominal. In the method shown in FIG. 1 the alloy is heated to about 1010° C, cooled to about 20° C, heated to about 650° C, maintained at that temperature for several hours, cooled to 20° C, heated to about 750° C, and cooled to room temperature. In the method shown in FIG. 2 the second cooling step is omitted and the alloy is heated from 650° to 750° C for the final heat treatment. In the method of FIG. 3 both intermediate cooling steps are omitted, the alloy being cooled from 1010° to 650° C, kept at this temperature for several hours, heated to 750° C for the final heat treatment, and then cooled to room temperature.

Examples illustrating the previously described aspects of the invention are now described.

Figure 4:
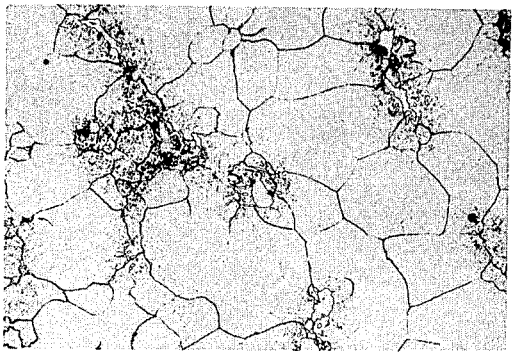
Figure 5:
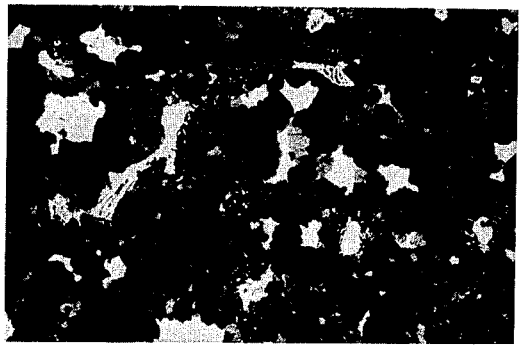

An alloy having the composition by weight of 1.1% carbon, 5.7% manganese, 1.7% cobalt, 1.9% chromium, 1.8% molybdenum, 1.1% silicon, balance iron plus minor amounts of incidental impurities, was heat treated according to the invention. The microstructures and hardnesses were recorded at each stage of the sequence. The results are shown below in Table 1 and the structures are illustrated in the photomicrographs shown in FIGS. 4, 5 and 6 of the accompanying drawings. The micrographs shown in FIGS. 4 and 5 were at magnifications of ×250 and FIG. 6 was at the magnification of ×630.

TABLE 1

Figure 6:
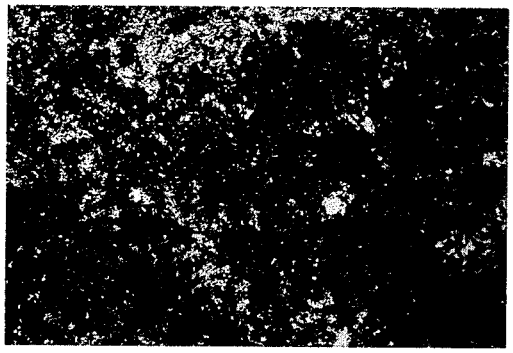

| SPECIMEN | OBSERVATIONS |
|---|---|
| A. Austenitized by heating at 1000° C and cooled in air blast to room temperature. | Discrete primary carbides and fine secondary carbides uniformly dispersed in an austenitic matrix. Hardness 24 Rockwell C. |
| B. As for A, then heated for 4 hours at 640° C. | Carbide distributed as in A, but matrix became fine lamellar pearlite with some upper bainite. Hardness 40 Rockwell C. |
| C. As for B, then heated for 4 hours at 740° C and cooled to room temperature. | Primary carbides distributed as in A, but matrix becomes martensitic. FIG. 6 shows a groundmass of fine spherodized carbide. Hardness 62 Rockwell C. |

For applications where the alloy may be required to be used in the fully austenitic state for maximum ductility, the austenite must be sufficiently stable to avoid breakdown to other harder and less ductile constitutents during its service life within defined environmental temperatures.

To determine some thermal characteristics of the alloy the products of three melts with the compositions shown in Table 2, were austenetised at 1000° C before rapidly cooling to room temperature.

Specimens of these alloys were cycled at temperatures in the range of −60° to 200° C for up to 52 hours and then examined using X-Ray diffraction techniques. No evidence of any transformation products was obtained indicating that the Ms temperature is below −60° C, and no pearlitic products are formed below 200° C.

TABLE 2

| Heat No. | Element % by weight C | Mn | Co | Cr | Mo | Si |
|---|---|---|---|---|---|---|
| M884 | 1.2 | 7.3 | 1.8 | 2.0 | 2.0 | 1.3 |
| M971 | 1.1 | 5.7 | 1.7 | 1.9 | 1.8 | 1.1 |
| M978 | 1.1 | 5.9 | 1.9 | 2.0 | 1.8 | 1.0 |

Other incidental impurities such as nickel, tungsten, vanadium, sulphur and phosphorus were also present.

Laboratory tests to evaluate wear resistance were carried out using the method outlined below:

Specimens of various alloys, including the steel of the invention, were bolted onto the periphery of a steel disc. The assembly was fastened to a drill chuck and the specimens rotated in a silicon carbide and corundum abrasive slurry.

The specimens were cleaned, dried and weighed prior to commencement of and at time intervals during the test. The materials used in the test and the results obtained are shown in Table 3.

TABLE 3

| 1st Test Duration 205 hours Specimen | Weight Loss (grams) | 2nd Test Duration 255 hours Specimen | Weight Loss (grams) |
|---|---|---|---|
| T4316-1 Hardened | 0.325 | M971 (1) Hardened | 0.357 |
| M971 Austenitised | 0.365 | M971 (2) Hardened | 0.360 |
| 13% Manganese Steel | 0.440 | 13% Manganese Steel | 0.582 |
| Alloyed Cast Iron ASTM532 Type I | 0.314 | ASTM532 Type 1 | 0.335 |

The compositions (apart from iron and incidental impurities) of Heats T4316-1 and M971 were:

| | Carbon | Manganese | Cobalt | Chromium | Molybdenum | Silicon |
|---|---|---|---|---|---|---|
| T4316-1 | 0.99 | 5.0 | Trace | 1.9 | 1.7 | 0.80 |
| M971 | 1.1 | 5.7 | 1.7 | 1.9 | 1.8 | 1.1 |

The results indicate that under the conditions of the above mentioned test, the alloys in accordance with the invention show considerable improvement in wear resistance when compared to the 13% manganese steel type, and when in the fully hardened condition have a wear resistance approaching that of the ASTM32 Type 1 alloyed cast iron.

Assessment of the machinability of pearlitic manganese steel of this invention based on operator experience indicates a rating of better than 40% of Water Hardening Tool Steel, reference American Society for Metals — Metals Handbook Volume 3, "Machinability Ratings for Annealed Tool Steels."

The following tests were conducted to compare the relative work hardenabilities of the alloy of the invention and 12–14% manganese steel.

Square test pieces were ground and austenitised in a vacuum at 1000° C followed by rapid cooling to room temperature in a blast of argon gas.

Each of the test pieces was then shot peened under standard conditions for 2 and 4 minutes. Micro-hardness testing of the surfaces and on cross sections gave results which are shown in Table 4.

TABLE 4

| Test Specimen | Peening Time Two Minutes: Surface Hardness Vickers Hardness 200g. Load. | Hardness 0.001" below surface HV200g. | Depth of Hardened Zone from Surface | Peening Time Four Minutes: Surface Hardness HV200g. | Hardness 0.001" below Surface HV200g. | Depth of Hardened Zone from Surface |
|---|---|---|---|---|---|---|
| | Average Values | Average Values | Average Values | Average Values | Average Values | |
| 12–14% Mn(1) | 770 | 662 | 0.025" | 833 | 726 | Not determined |
| 12–14% Mn(2) | 780 | 694 | 0.025" | 802 | 710 | Not determined |
| Heat M971 | 830 | 690 | 0.028" | 841 | 720 | Not determined |
| Heat M976 | 870 | 685 | 0.025" | 918 | 830 | Not determined |
| Heat T4316-1 | 910 | 700 | 0.028" | — | — | — |
| Heat T4316-2* | 946 | 820 | 0.022" | 927 | 848 | Not determined |

*Chemical composition similar to T4316-1 referred to below Table 3 except with 4.2% Cobalt addition.

I claim:

1. A method of manufacturing a manganese steel having a hardness in excess of 50 on the Rockwell C scale which comprises the steps of heating an alloy consisting essentially of, by weight

| | |
|---|---|
| Carbon | 0.9 to 1.4% |
| Manganese | 3.0 to 8.0% |
| Chromium | 1.0 to 2.5% |
| Molybdenum | 0.5 to 2.5% |
| Silicon | 0.25 to 2.0% |
| Cobalt | 1.0 to 5.0% |
| with the balance iron plus incidental impurities | |

with the balance iron plus incidental impurities at a temperature within the range 900° to 1100° C, cooling the alloy to a temperature below 690° C, maintaining the alloy at a temperature within the range 500° to 690° C for a period in excess of 1 hour, heating the alloy to a temperature within the range 690° to 800° C for a period in excess of 5 minutes, and cooling the alloy to a temperature below 50° C.

2. A hard manganese steel having a hardness in excess of 50 on the Rockwell C scale produced by heating an alloy consisting essentially of, by weight

| | |
|---|---|
| Carbon | 0.9 to 1.4% |
| Manganese | 3.0 to 8.0% |
| Chromium | 1.0 to 2.5% |
| Molybdenum | 0.5 to 2.5% |
| Silicon | 0.25 to 2.0% |

-continued

| | |
|---|---|
| Cobalt | 1.0 to 5.0% |

with the balance iron plus incidental impurities at a temperature within the range 900° to 1100° C, cooling the alloy to a temperature below 690° C, maintaining the alloy at a temperature within the range 500° to 690° C for a period in excess of 1 hour, heating the alloy to a temperature within the range 690° to 800° C for a period in excess of 5 minutes, and cooling the alloy to a temperature below 50° C.

3. A method according to claim 1 wherein the alloy has the following composition by weight:

| | |
|---|---|
| Carbon | 1.1 to 1.3% |
| Manganese | 5.0 to 6.3% |
| Chromium | 1.6 to 2.2% |
| Molybdenum | 1.4 to 2.0% |
| Silicon | 0.8 to 1.4% |
| Cobalt | 1.0 to 5.0% |

within the balance iron plus incidental impurities.

4. A method according to claim 1 wherein the alloy also contains vanadium up to 2% by weight.

5. A method according to claim 1 wherein the hard manganese steel has a hardness in excess of 58 on the Rockwell C scale.

6. A method according to claim 1 wherein the microstructure of the hard manganese steel consists predominantly of carbides dispersed in a martensitic matrix.

7. A method according to claim 1 wherein the hard manganese steel is stress relieved by tempering at a temperature within the range 200° to 650° C.

* * * * *